US011287125B2

(12) United States Patent
Yan et al.

(10) Patent No.: US 11,287,125 B2
(45) **Date of Patent: *Mar. 29, 2022**

(54) INFLATABLES WITH LIGHTING MODULE, SYSTEMS, AND METHODS

(71) Applicants: Polygroup Macau Limited (BVI), Tortola (VG); Eric Szweda, Hong Kong (CN)

(72) Inventors: Jinming Yan, Shenzhen (CN); Ricky Tong, Shenzhen (CN); Victor Hugo Ocegueda Gallaga, Baja California (MX)

(73) Assignee: Polygroup Macau Limited (BVI), Tortola (VG)

( * ) Notice: Subject to any disclaimer, the term of this patent is extended or adjusted under 35 U.S.C. 154(b) by 0 days.

This patent is subject to a terminal disclaimer.

(21) Appl. No.: 17/090,098

(22) Filed: Nov. 5, 2020

(65) Prior Publication Data

US 2021/0063010 A1 Mar. 4, 2021

Related U.S. Application Data

(63) Continuation of application No. 16/170,823, filed on Oct. 25, 2018, now Pat. No. 10,871,284.

(Continued)

(51) Int. Cl.

*F21V 33/00* (2006.01)
*F21V 23/00* (2015.01)

(Continued)

(52) U.S. Cl.

CPC ..... *F21V 33/008* (2013.01); *A63H 3/06* (2013.01); *A63H 27/10* (2013.01); *A63H 33/22* (2013.01);

(Continued)

(58) Field of Classification Search

None

See application file for complete search history.

(56) References Cited

U.S. PATENT DOCUMENTS 5,639,076 A ‡ 6/1997 Cmiel ..... A63B 43/06 362/806
5,782,668 A ‡ 7/1998 Chabert ..... A63H 27/10 446/220

(Continued)

FOREIGN PATENT DOCUMENTS

CN 101871616 A 10/2010
CN 106978917 A 7/2017

(Continued)

OTHER PUBLICATIONS

European Search Report from Application No. 18202471.1 dated Jan. 4, 2019.‡

*Primary Examiner* — Vip Patel

(74) *Attorney, Agent, or Firm* — Finnegan, Henderson, Farabow, Garrett & Duner LLC

(57) ABSTRACT

A lighted inflatable apparatus including: a wall comprising a first inflatable chamber; at least one lighting element disposed within the wall, the at least one lighting element configured to emit light; and a control box connected to the at least one lighting element, the control box configured to control one or more emission states of the at least one lighting element.

20 Claims, 8 Drawing Sheets

Related U.S. Application Data

(60) Provisional application No. 62/576,914, filed on Oct. 25, 2017.

(51) Int. Cl.

| | |
|---|---|
| ***F21V 23/02*** | (2006.01) |
| ***F21V 23/04*** | (2006.01) |
| ***E04H 4/00*** | (2006.01) |
| ***E04H 4/14*** | (2006.01) |
| ***F21V 31/00*** | (2006.01) |
| ***A63H 33/22*** | (2006.01) |
| ***A63H 3/06*** | (2006.01) |
| ***F21S 10/04*** | (2006.01) |
| ***F21S 9/02*** | (2006.01) |
| ***F21S 10/02*** | (2006.01) |
| ***B63B 45/02*** | (2006.01) |
| ***A63H 27/10*** | (2006.01) |
| ***H05B 45/24*** | (2020.01) |
| *F21Y 115/10* | (2016.01) |
| *F21Y 113/13* | (2016.01) |
| *F21Y 105/10* | (2016.01) |

(52) U.S. Cl.

CPC ..... *B63B 45/02* (2013.01); *E04H 4/0025* (2013.01); *E04H 4/148* (2013.01); *F21S 9/02* (2013.01); *F21S 10/023* (2013.01); *F21S 10/043* (2013.01); *F21V 23/007* (2013.01); *F21V 23/02* (2013.01); *F21V 23/0485* (2013.01); *F21V 31/00* (2013.01); *F21V 31/005* (2013.01); *H05B 45/24* (2020.01); *A63H 2027/1058* (2013.01); *A63H 2027/1091* (2013.01); *F21Y 2105/10* (2016.08); *F21Y 2113/13* (2016.08); *F21Y 2115/10* (2016.08)

(56) References Cited

U.S. PATENT DOCUMENTS

| | | | | |
|---|---|---|---|---|
| 6,012,826 | A ‡ | 1/2000 | Chabert | F21V 3/026 362/363 |
| 6,106,135 | A ‡ | 8/2000 | Zingale | A63H 27/10 362/186 |
| 6,196,471 | B1 | 3/2001 | Ruthenberg | |
| 9,080,736 | B1 | 7/2015 | Salzinger et al. | |
| 2007/0262725 | A1 ‡ | 11/2007 | Koren | F21K 9/00 315/18 |
| 2009/0044327 | A1 ‡ | 2/2009 | Cheng | E04H 4/0025 4/506 |
| 2010/0309654 | A1 ‡ | 12/2010 | Jeffrey | A63H 27/10 362/190 |
| 2013/0187569 | A1 ‡ | 7/2013 | Chin-Huan | F21V 3/026 315/30 |
| 2014/0357333 | A1 ‡ | 12/2014 | Canobbio | A63H 27/10 463/7 |
| 2015/0097761 | A1 ‡ | 4/2015 | Davis | F21V 3/026 345/55 |
| 2017/0067268 | A1 ‡ | 3/2017 | Tong | E04H 4/0025 |

FOREIGN PATENT DOCUMENTS

| | | | | |
|---|---|---|---|---|
| MX | 2009009632 | A ‡ | 9/2009 | A63H 27/10 |
| MX | 2009009632 | A | 9/2009 | |
| WO | 2011024111 | A1 | 3/2011 | |
| WO | 2017116901 | A1 | 7/2017 | |

‡ imported from a related application

INFLATABLES WITH LIGHTING MODULE, SYSTEMS, AND METHODS

CROSS-REFERENCE TO RELATED APPLICATIONS

This application claims the benefit, under 35 U.S.C. § 120 to U.S. patent application Ser. No. 16/170,823 filed 25 Oct. 2018 the, which claims benefit under 35 U.S.C. § 119(e), of U.S. Provisional Patent Application No. 62/576,914 filed Oct. 25, 2017, the content of which is incorporated by reference herein as if it was restated in full.

TECHNICAL FIELD

This present disclosure generally relates to inflatable products, and more particularly to inflatable products having internal lighting and a lighting module thereof.

BACKGROUND

Inflatable products, such as inflatable beds, pools, desks, boats, and toys, can be a source of fun, relaxation, and enjoyment. In the absence of an independent light source, however, inflatable products may provide limited enjoyment in a dark environment, such as at night, as darkness may render use of an inflatable product dangerous due to poor visibility. Moreover, lighted inflatable products intended for use in and near water require special considerations due to long-term viability and usability. Thus, it is desirable to provide an inflatable product with a built-in light source, so that the inflatable product may be used at night. Furthermore, it may be desirable to provide lighting of different colors to enhance enjoyment of the inflatable product.

SUMMARY

Briefly described, embodiments of the presently disclosed subject matter relate to inflatable products having internal lighting. According to some embodiments, there is provided a lighted inflatable apparatus including: a wall comprising a first inflatable chamber; at least one lighting element disposed within the wall, the at least one lighting element configured to emit light; and a control box connected to the at least one lighting element, the control box configured to control one or more emission states of the at least one lighting element.

The wall may form a recess, the control box being positioned in the recess.

The control box may include: a main housing; a power button; and a switch operatively connected to the power button and sealed from the power button, the switch being configured to alter an operating mode of the control box.

The control box may further include a seal disposed between the power button and the switch.

The control box may further include a filler between an edge of the seal and the main housing.

The control box may further include a control circuit configured to control the one or more emission states of the one or more lighting elements.

The control box may further include a frame configured to hold the control circuit.

The frame may provide a water-tight seal around the control circuit.

The inflatable device may further include a battery housing configured to receive one or more batteries.

The battery housing may be physically separate from the control box.

In some embodiments, there is provided a lighted inflatable device including: a wall comprising a first inflatable chamber; at least one lighting element disposed within the wall, the at least one lighting element configured to emit light; at least one impact sensor configured to detect physical impact to the wall; and a control box connected to the at least one lighting element, the control box configured to control one or more emission states of the at least one lighting element.

The inflatable device may be configured to alter, in response to the at least one impact sensor detecting physical impact to the wall, an emission state of the at least one lighting element.

Altering the emission of the at least one lighting element may include at least one from among adjusting a brightness of the at least one lighting element, adjusting a flicker state of the at least one lighting element, adjusting a color of the at least one lighting element, and adjusting an on state of the at least one lighting element.

The inflatable device may be further configured revert, after a predetermined period of time following the at least one impact sensor detecting physical impact to the wall, the emission state of at least one lighting element.

The at least one impact sensor may be embedded with the at least lighting element.

The inflatable device may be configured to cycle, in response to the at least one impact sensor detecting successive physical impacts to the wall, the emission state of the at least one lighting element.

The inflatable device may be configured to alter, in response to a first impact sensor of the at least one impact sensor detecting physical impact to the wall, an emission state of one or more lighting elements of the at least one lighting elements proximate to the first impact sensor.

The inflatable device may further include: a plurality of impact sensors disposed about the wall; and a plurality of lighting elements disposed about the wall. Each of the plurality of impact sensors may be configured to, in response to detecting an impact, alter an emission state of a respective subset of the plurality of lighting elements.

Each of the plurality of impact sensors may be embedded with, and configured to control, a respective lighting element of the plurality of lighting elements.

According to some embodiments, there is provided a lighted inflatable device including: a wall comprising a first inflatable chamber; a first plurality lighting elements disposed within the wall, the first plurality of lighting elements configured to emit light; a control box connected to the first plurality of lighting elements, the control box configured to control one or more emission states of the first plurality of lighting elements; a second plurality of lighting elements disposed within the wall, the second plurality of lighting elements configured to emit light; and at least one impact sensor configured to detect physical impact to the wall and control, in response to detecting physical impact to the wall, one or more emission states of the second plurality of lighting elements.

BRIEF DESCRIPTION OF THE FIGURES

Reference will now be made to the accompanying figures, which are not necessarily drawn to scale, and wherein.

DETAILED DESCRIPTION

Figure 1:
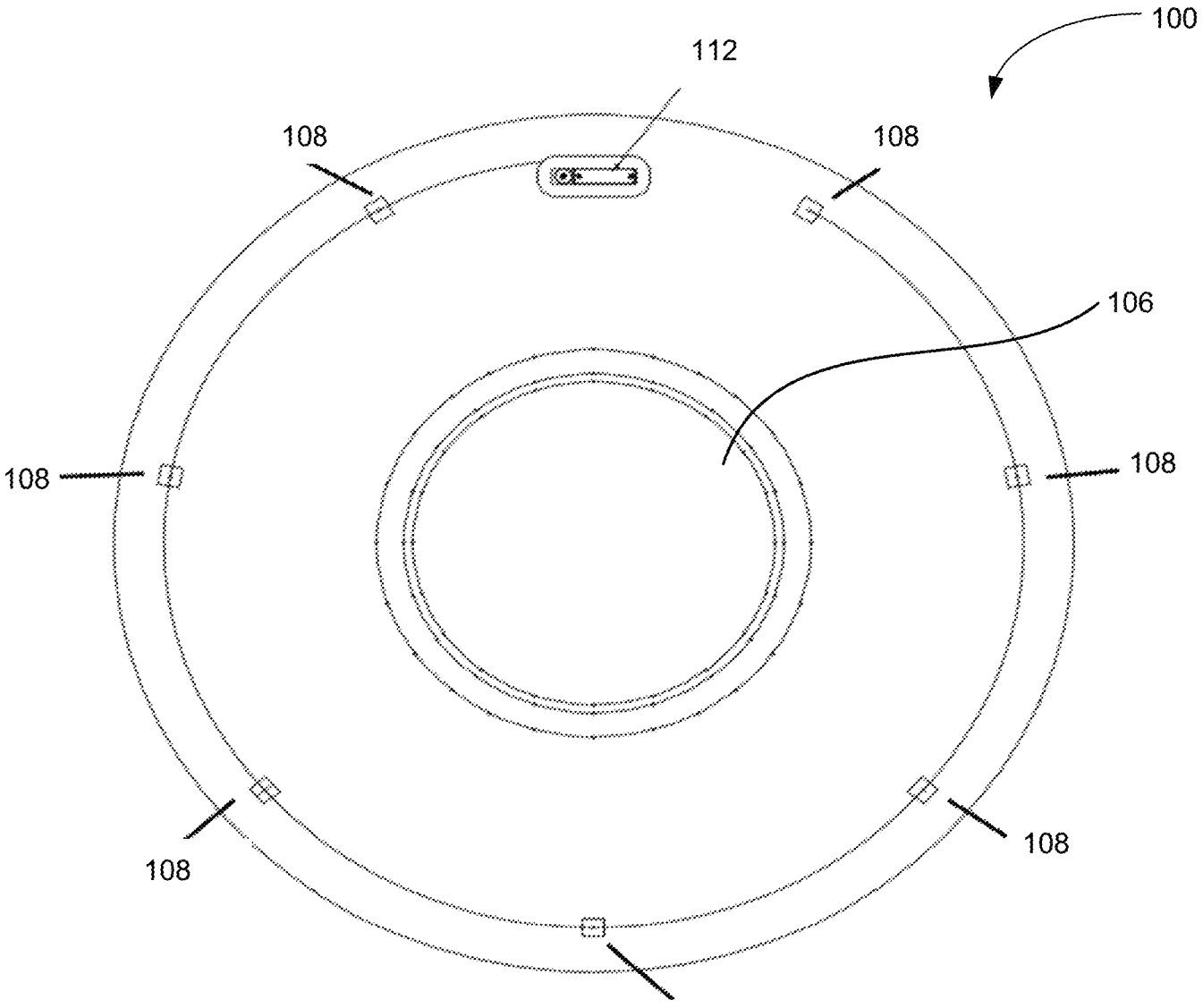
FIG. 1 is a top view of a lighted inflatable product, in accordance with an example embodiment.

The present disclosure can be understood more readily by reference to the following detailed description of exemplary embodiments and the examples included herein. It is to be understood that embodiments are not limited to those described within this disclosure. Numerous modifications and variations therein will be apparent to those skilled in the art and remain within the scope of the disclosure. It is also to be understood that the specific terminology used herein is for the purpose of describing specific embodiments only and is not intended to be limiting. Some embodiments of the disclosed technology will be described more fully hereinafter with reference to the accompanying drawings. This disclosed technology may, however, be embodied in many different forms and should not be construed as limited to the embodiments set forth therein.

In the following description, numerous specific details are set forth. However, it is to be understood that embodiments of the disclosed technology may be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," etc., indicate that the embodiment(s) of the disclosed technology so described may include a particular feature, structure, or characteristic, but not every embodiment necessarily includes the particular feature, structure, or characteristic. Further, repeated use of the phrase "in one embodiment" does not necessarily refer to the same embodiment, although it may.

Unless otherwise noted, the terms used herein are to be understood according to conventional usage by those of ordinary skill in the relevant art. In addition to any definitions of terms provided below, it is to be understood that as used in the specification and in the claims, "a" or "an" can mean one or more, depending upon the context in which it is used. Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to, and are not intended to imply that the objects so described must be in a given sequence, either temporally, spatially, in ranking, or in any other manner.

Also, in describing the exemplary embodiments, certain terminology will be resorted to for the sake of clarity. It is intended that each term contemplates its broadest meaning as understood by those skilled in the art and includes all technical equivalents that operate in a similar manner to accomplish a similar purpose.

To facilitate an understanding of the principles and features of the embodiments of the present disclosure, exemplary embodiments are explained hereinafter with reference to their implementation in one or more illustrative embodiment. Such illustrative embodiments are not, however, intended to be limiting.

Embodiments of the disclosed technology include a lighted inflatable product for providing increased visibility of the inflatable product, particularly in dark environments. A lighted inflatable product may be an inflatable pool and be further configured to illuminate water held in the pool. In various embodiments, a lighted inflatable product may provide various different-colored lighting schemes. In some embodiments, the color of the lighting of the inflatable product may be controlled by a control box and power button. Certain embodiments may utilize impact activated lighting modules (e.g., impact activated LEDs) to provide variable lighting.

Throughout this disclosure, certain embodiments are described in exemplary fashion in relation to a lighted inflatable product.

Referring now to the drawings, FIG. 1 illustrates a perspective view of an embodiment of a lighted inflatable product 100. According to some embodiments, the lighted inflatable product 100 may include a wall 101 that forms one or more inflatable chambers 102. In some cases, wall 101 may have a gloss surface or a partial-gloss surface. The lighted inflatable product 100 can further include one or more lighting elements 108. According to some embodiments, lighting elements 108 can be inside internal chamber 102. According to some embodiments, the wall 101 can be made of a transparent or translucent material such that lighting elements 108 can serve to illuminate the lighted inflatable product 100 when turned on. In some embodiments, one or more pockets may be formed in the wall 101, and the lighting elements 108 may be disposed therein. In some cases, the wall may have more than one layer, and the lighting elements 108 may be disposed between layers of the wall.

For convenience, much of this disclosure is described with regards to example embodiments of a lighted inflatable product 100 having a single wall 101 and a single chamber 102, but it will be understood by those of skill in the art that, in various embodiments, lighted inflatable product 100 may have a plurality of walls 101 and/or a plurality of chambers 102, and plurality of sub-chambers.

The chamber 102 generally can be hollow and can be configured to inflate upon receiving air pumped or blown therein. According to some embodiments, the lighted inflatable product 100 can include a single inflatable chamber 102. In some embodiments, a chamber 102 can have internal walls that serve to divide a chamber into a series of chambers 102 or sub-chambers. In some cases, the internal walls may provide support or structure to the chamber 102, or guide the shape of the chamber 102 as it inflated or deflated. In some cases, the lighting elements 108 may be attached to or embedded within one or more internal walls.

Furthermore, according to some embodiments, a chamber 102 may contain one or more rigid internal members. Such rigid internal members can provide structure to the chamber. For example, a rigid member can be attached generally perpendicularly to two or more opposing internal surfaces of a chamber 102 to separate the internal surfaces and prevent them from touching, or restrict or guide the shape of the chamber 102 as it is inflated or deflated. According to some embodiments, such rigid internal members can provide a sturdier structure to an inflatable chamber 102. In some cases, the lighting elements 108 may be attached to or embedded within one or more rigid internal members.

According to some embodiments, when inflated, one or more chambers 102 can be, for example, generally cylindrical or have any shape. As previously described, a lighted inflatable product 100 can include a plurality of chambers that can be generally attached to one another (e.g., by sharing a common inner wall).

In some embodiments, a lighted inflatable product 100 can have multiple inflatable chambers 102 and each chamber 102 can be inflated separately from one another (e.g., isolated chambers 102). In some cases, lighted inflatable product 100 can have multiple inflatable chambers 102, and the chambers 102 may be inflated or deflated together (e.g., communicative chambers 102). It will be understood by those of skill in the art that a lighted inflatable product 100 can have one or more valves to allow air or another fluid to be inserted or removed to inflate or deflate the lighted inflatable product 100.

According to some embodiments, the wall 101, and chamber 102, can be made from plastic, PVC, and/or vinyl. According to some embodiments, a lighted inflatable product 100 can be made of a material that does not stretch when the lighted inflatable product 100 is inflated. For example, an inflatable product 100 configured as a swimming pool can have a substantially consistent shape and volume when substantially inflated, regardless of the internal air pressure.

In some embodiments of an inflatable product 100 that is configured as a swimming pool, chamber 102 and base 106 can be attached to one another in a manner that can provide a seal to prevent any liquid from leaking out of the product 100. For example, the chamber 102 and base 106 can be welded together. As will be understood by those of the skill in the art, when a lighted inflatable product 100 is inflated, it can be configured to contain materials, such as water, within the boundaries formed by the wall 101.

In some cases, the lighting elements 108 may include one or more impact sensors. In certain embodiments, the impact sensors may activate or adjust one or more of the lighting elements 108. For example, an inflatable product 100 configured as a swimming pool may include one or more impact sensors along the wall 101 (e.g., both inside and outside) such that, when a user leans against the wall 101, the impact sensors are activated. The impact sensors may activate one or more lighting elements 108 (e.g., lighting elements 108 near the impact sensor). Activating the lighting elements 108 may include one or more of turning on, turning off, pulsing, and/or changing the color of the lighting elements 108. In some cases, the impact sensor may be integrated with the lighting elements 108. In some embodiments, the impact sensors may control the lighting elements 108 directly. In certain implementations, impact sensors may transmit signals indicated of impact to a control element (e.g., control box 112), and the control element may activate the lighting elements 108. According to certain embodiments, there may be provided multiple sets of lighting elements 108. In some cases, a first set of lighting elements 108 may be controlled by the impact sensors, and a second set of the lighting elements 108 may be controlled by the control element.

Figure 2:
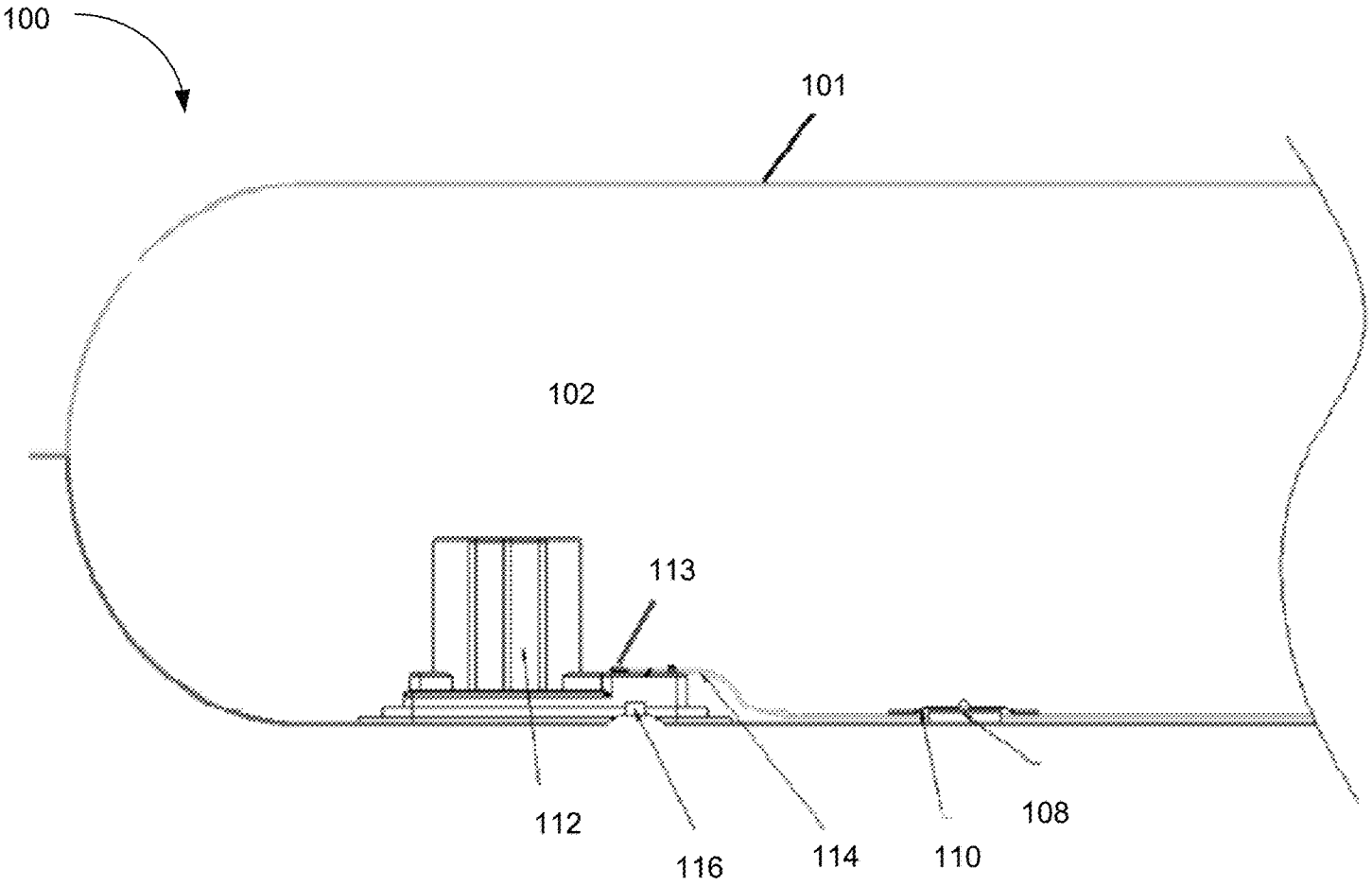
FIG. 2 is a cross-sectional view of a lighted the presently disclosed subject matter.

FIG. 2 illustrates a cross-sectional view of a lighted inflatable product 100. According to the embodiment shown in FIG. 2, lighted inflatable product 100 includes a wall 101.

According to some embodiments, one or more lighting elements 108 can be disposed within the wall 101. According to some embodiments, one or more lighting elements 108 can be attached to a surface of wall 101. In some embodiments, one or more lighting elements 108 can be attached to an inner surface of wall 101. As shown in FIG. 2, lighting elements 108 can be attached to an inner surface of the bottom wall 101*b*. Wall 101 can be made from a clear or transparent material such that light emanating from one or more lighting elements 108 may pass through the surface of the wall 101 and illuminate the lighted inflatable product 100 and, in some cases, its contents. In some embodiments, portions of the wall 101 may be made from different materials. For example, bottom wall 101*b* may be made from stronger or thicker material than the rest of the wall 101.

In addition to lighting elements 108, chamber 102 can also house an attachment member 110, a control box 112, a connector 113 and wiring 114. In some embodiments, lighting elements 108, attachment member 110, a control box 112, a connector 113 and wiring 114 can be housed in the wall 101, for example, within chamber 102. According to some embodiments, control box 112 can be positioned externally to the chamber 102. In some embodiments, control box 112 may be deposited within a pocket formed by wall 101 external or internal to the chamber 102. In some cases, control box 112 may be formed integral with wall 101 such that a portion of the control box 112 extends into the chamber 102. In some embodiments, if control box 112 is positioned externally to the chamber 102, wall 101 may have apertures to allow wiring 114 to pass from the control box 112 into the internal space of the chamber 102. According to some embodiments, such apertures can be sealed around the wiring 114 to create an airtight space within the chamber 102.

According to some embodiments, lighting elements 108 can be any electrically activated light source. For example, a lighting element can be an incandescent light bulb or and LED. In some embodiments, lighting element 108 can be capable of changing colors based on a built-in program of a lighting unit. For example, a lighting element can be an RGB LED. In some embodiments, lighting elements 108 can be assembled in groups. For example, according to some embodiments, lighting elements 108 can be assembled as one or more light strings. In some embodiments, a light string can have a main printed circuit board assembly (PCBA) to control all LEDs, for example, to change transition colors every 60 seconds. According to some embodiments, a lighted inflatable product 100 can have one or more groups of lighting elements 108, such as a series of light strings. For example, in some embodiments, a group of lighting elements 108 can be a series of three or more LEDs in a row, as shown by the lighting elements 108 in FIG. 1. In some embodiments, one or more groups of lighting elements 108 can be connected to one another in parallel or in series. In some embodiments, lighting elements 108 may be driven by, for example, a plurality of disposable or reusable batteries, such as 3 or 4 AA batteries. In some embodiments, the lighting elements 108 may have a working voltage of, for example, 6 volts DC.

As will be understood by those of skill in the art, an RGB LED light string can be made up of a red, a green, and a blue LED, each of which are selectively turned off and on or varied in brightness by adjusting power controls to create an array of different colors. As non-limiting examples, to create an array of different colors, each of the LEDs may be selectively turned off and on at a high frequency rate and may have individual variations in the ratio of on vs. off cycles (e.g., through a Pulse Width Modulation (PWM) process), each of the LEDs may be individually varied in brightness to create variations in light intensity, or power controls for each of the LEDs may be individually adjusted. In some embodiments, the LED brightness and modes are controlled by a built-in program (e.g., firmware or an integrated circuit) within the LED chips. In some embodiments, an RGB LED can also use red, green, and blue LED chips to combine colors. For example, if both the red LED (or chip) and blue LED (or chip) are activated, the colors can combine and the RGB LED can emit a color that is substantially magenta. The colors of the lighting elements 108 may be controlled by, for example, elements of the control box 112 or by a built-in program. By varying the degree to which each color is generated, an RGB LED can generate myriad colors from the combinations of different magnitudes of red, green and blue emitted light.

According to some embodiments, one or more lighting elements 108 can be attached to an inner surface of the wall 101 by one or more attachment members 110. An attachment member 110 can be any mechanism for attaching or securing one or more lighting elements 108 to a surface of the wall 101. For example, an attachment member can include, but is not limited to, adhesive film, an adhesive material, welding, a staple, glue, a magnet, Velcro, or any other means or methods of attaching a lighting element 108 to a wall 101 or other portions of lighted inflatable product 100. In some embodiments, a portion of the attachment member can be attached to a surface of the wall 101 in such a manner that tension is created to press the lighting elements 108 against the surface of the wall 101. According to some embodiments, attachment member 110 can be attached at to the inner surface of wall 101, for example, to the inner surface of a chamber 102, to secure one or more lighting elements 108 in place. For example, attachment member 110 can be welded, sewn, glued, or otherwise attached to the inner surface of the chamber 102 to secure one or more lighting elements 108 in place. According to some embodiments, the attachment member 110 can be detachably attached to the inner wall of the chamber 102 to allow for the removal and replacement of lighting elements 108. It will be understood by those of skill in the art that a variety of other securing means can be used to secure lighting elements 108 to the inner wall of a chamber.

According to some embodiments, one or more lighting elements 108 can be sealed inside chamber 102, such that the one or more lighting elements 108 are isolated from exposure to an environment outside the chamber 102. For example, if the lighted inflatable product 100 is a pool, the lighting elements 108 may be protected from water placed in lighted inflatable product 100.

In some embodiments, a plurality of lighting elements 108 can be placed within the chamber 102, and can be secured to a portion of an inner surface of the chamber 102 that is proximate to the inside of the lighted inflatable product 100. According to some embodiments, the surface of chamber 102 can be generally transparent or translucent, such that light emitted by lighting elements 108 can shine through the surface of the chamber 102 and provide light from within lighted inflatable product 100.

Although lighting elements 108 have generally been described as housed within the chamber 102, this is merely an example, and the lighting elements 108 (and the corresponding attachment member 110, control box 112, connector 113 and wiring 114) can be housed in chamber 102, any portion of wall 101, or internally in any other aspect of inflatable product 100.

Figure 3:
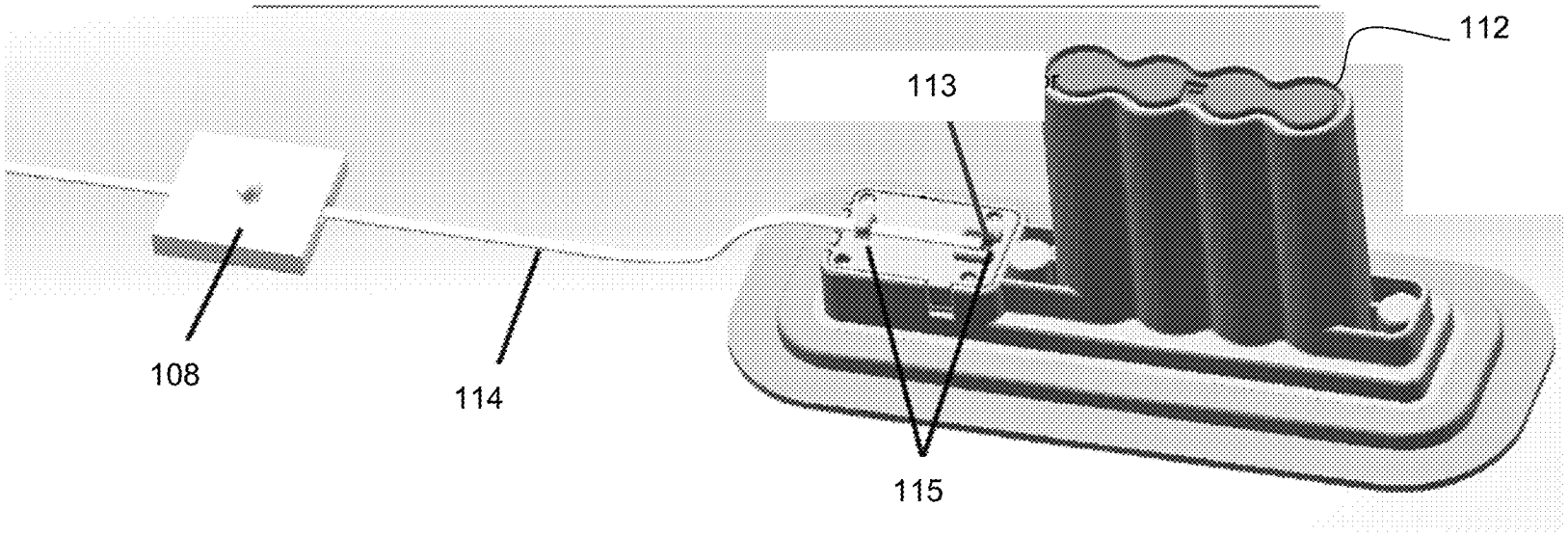
FIG. 3 is a perspective view of a lighting module, in accordance with an example embodiment.

FIG. 3 shows an example embodiment a control box 112, a connector 113, wiring 114, wire locks 115, and the lighting elements 108.

According to some embodiments, control box 112 can receive control signals that can be used to determine the color or intensity of light to be emitted by the lighting elements 108. According to some embodiments, a control box 112 can contain a power source, such as a battery. According to some embodiments, one or more lighting elements 108 can be powered by a power source of a control box 112. In some embodiments, a power source of control box 112 can be made up of multiple batteries. For example, in some embodiments, a power source of control box 112 can be made up of, for example, four 1.5-volt DC batteries that can combine to provide 6 volts DC to the lighting elements 108. According to some embodiments, the power source of a control box 112 can be electrically connected to lighting elements 108 by wiring 114. If more than one group of lighting elements 108 is connected in series, the wiring 114 from the power source of control box 112 may only be connected to the first group of lighting elements 108 of the series. In some embodiments, the wiring 114 can include four conductors, which can include three conductors for controlling the RGB colors and a fourth conductor to control the voltage. For example, one conductor can control the amount of red color generated, one conductor can control the amount of blue color generated, and one conductor can control the amount of green color generated. By varying the degree to which each color is generated, an RGB LED can generate myriad colors from the combinations of different magnitudes of red, green and blue colors generated. In some embodiments, the wiring 114 can include two conductors, which can transfer power from control box 112 to lighting elements 108. In some cases, the wiring 114 may include only two connectors, and the color and brightness of lighting elements 108 may be varied by using PWM in combination with a built-in programming of the LEDs (e.g., an integrated circuit).

According to some embodiments, control box 112 can receive a command signal representative of a color to be generated by a lighting element 108 and can output signals via the wiring 114 to the lighting element configured to cause the lighting element 108 to generate the desired color. In some embodiments, the lighted inflatable product 100 can have a user interface (e.g., a keypad connected to the control box 112) that allows a user to turn the lighting elements 108 off and on, and/or change the color of the light generated by lighting elements 108 display different colors.

According to some embodiments, a control box 112 can have a power button 116 to turn off and on the lighting elements 108. In some cases, the control box 112 may have one or more states or modes other than "on" or "off," and pressing the power button 116 may cycle through these modes. For example, control box 112 may have a mode that continuously or repeatedly cycles through a pattern of different colors of lighting elements 108. According to some embodiments, connector 113 is used to connect control box 112 and light strings 108, and wire locks 115 on top of the connector 113 reinforce the position and enhance the firmness of the wiring 114. In some embodiments, control box 112 has the advantages of small volume and light weight. For example, the control box can be designed and made with a minimum size of 157.80L*63.2 W*68.5H (mm) to be compatible with most kinds of inflatable products.

Figure 4:
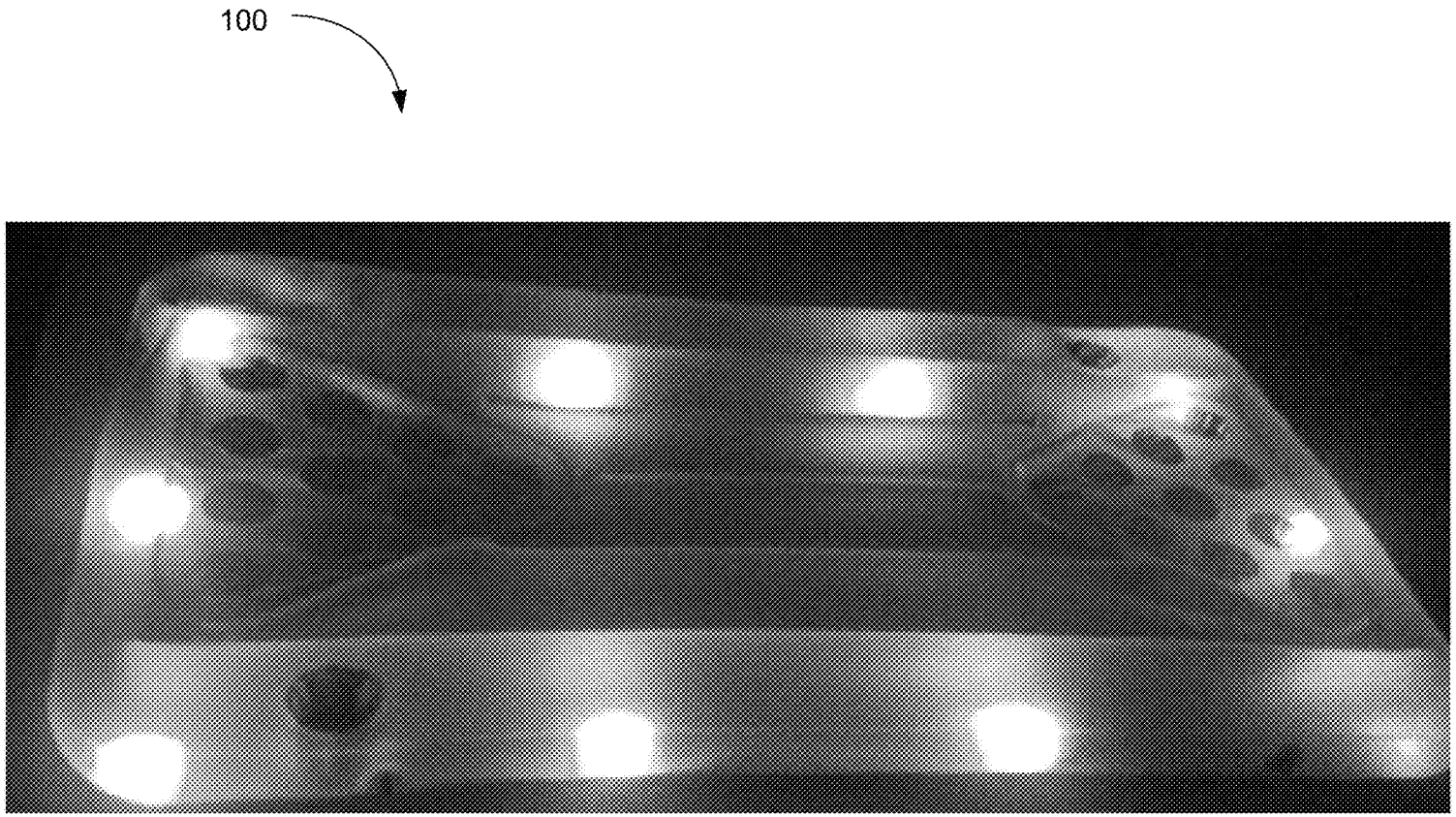
FIG. 4 is a perspective view of a lighted inflatable product in a lighted state, in accordance with an example embodiment.

FIG. 4 shows an embodiment of a lighted inflatable product 100 in a lighted state. The lighted inflatable product shows the lighting elements 108 emitting a light. According to some embodiments, combining one or more electric color features can create various distinct colors and achieve a kind of extreme color effect. According to some embodiments (e.g., as shown in FIG. 4), water contained within the inflatable product 100 (e.g., inflatable pool 100) can take on the color of the color of the lighting elements 108 when lighting elements 108 are turned on, for example, because lighting elements 108 are positioned around inflatable product 100 orientated to face the center of the inflatable product 100. Additionally, according to some embodiments, the wall 101 also can generally take on the color emitted by the lighting elements 108 (e.g., with a gloss-surface), which can create the impression that the entire lighted inflatable product 100 has a particular color or glow.

Although the disclosure herein is generally described with respect to an inflatable product having walls 101 forming generally cylindrical chambers 102, it will be understood by those of skill in the art that the disclosure is not so limited. There can be a wide variety of different inflatable product designs that can be equipped with lighting elements 108, secured by an attachment member 110 and having a control box 112 with wiring 114 to connect the control box to the lighting elements 108. Furthermore, according to some embodiments, a box 112, lighting elements 108, and wiring 114 can be inserted into different kinds of inflatable structures or inflatable toys to illuminate it or portions thereof in a similar manner to the manner described herein.

Figure 5:
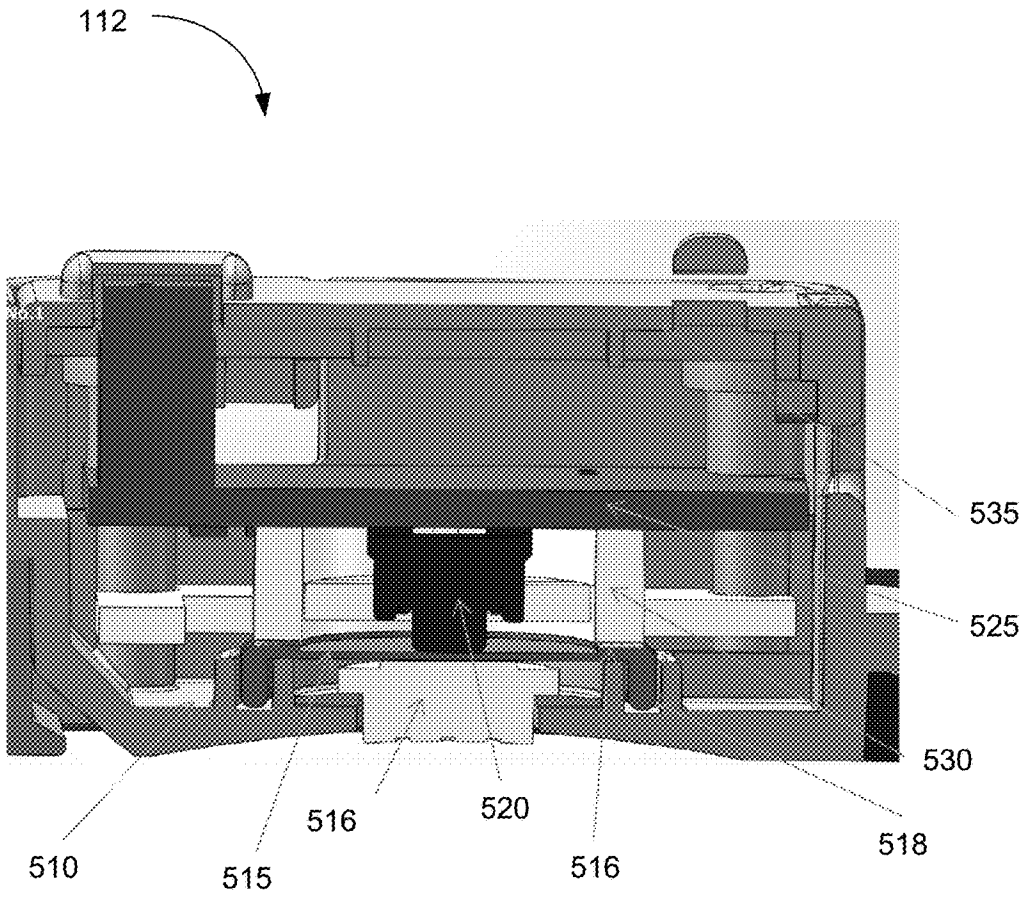
FIG. 5 is a cross-sectional view of a control box of a lighted inflatable product according to an example embodiment.

FIG. 5 is a cutaway view of a control box 112 according to an example embodiment. As can be seen, control box 112 includes a main housing 510 with power button 116 disposed thereon. A silicon seal 515 separates power button 116 from switch 520. The silicon seal 515 may cushion force provided by the power button 116 and transferred to the switch 520. In some cases, interference between the silicon seal 515 may provide a waterproof and airtight contact area 516. Glue or some other filler 518 may be provided between the silicon seal 515 (e.g., a side wall of the silicon seal 515) and the main housing 510, for example, to fill space and enhance the waterproof and airtight seal. Switch 520 changes operating modes of PCBA 525, which controls the state of lighting elements 108. Frame 530 holds the PCBA 530 within control box 112. Frame 530 may provide a water- and/or air-tight seal to protect the PCBA 525. Cover 535 isolates the PCBA from the remaining portions of the control box 112.

Figure 7:
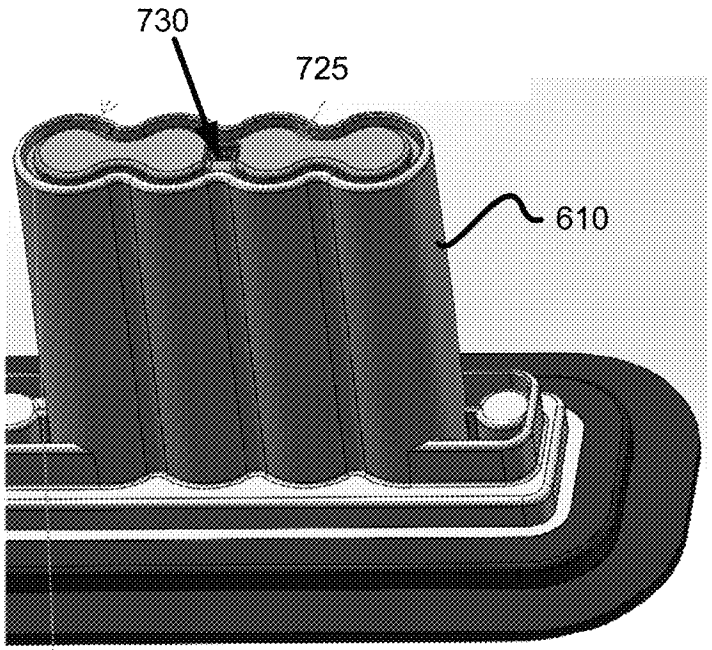
FIGS. 6-7 illustrate a battery housing of a control box of a lighted inflatable product according to an example embodiment.
Figure 6:
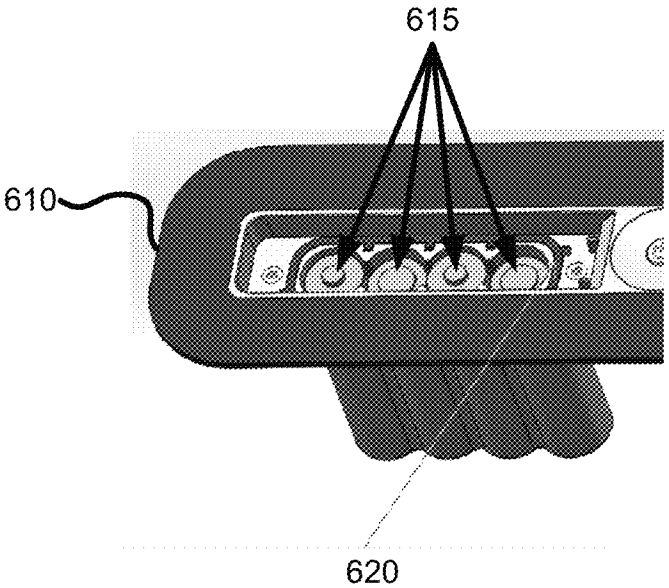

FIGS. 6 and 7 illustrate a battery housing of the control box 112 according to an example embodiment. As shown, FIG. 6 provides a perspective view of a top of the battery housing 610. Four batteries 615 may be fitting within battery housing 610. A silicon cushion 620 can be disposed around batteries 615. Silicon cushion 620 may provide a waterproof and/or airtight seal between the battery housing 610 and a battery cover 535. As further shown, FIG. 7 provides a perspective view of an outside of the battery housing 610. A back cover 725 is connected to the battery housing 610. Glue or some other sealant may be used to fill space and created a seal between the back cover 725 and the battery housing 610. A slot 730 may be formed to allow a cable to connect to the batteries 615.

Figure 8:
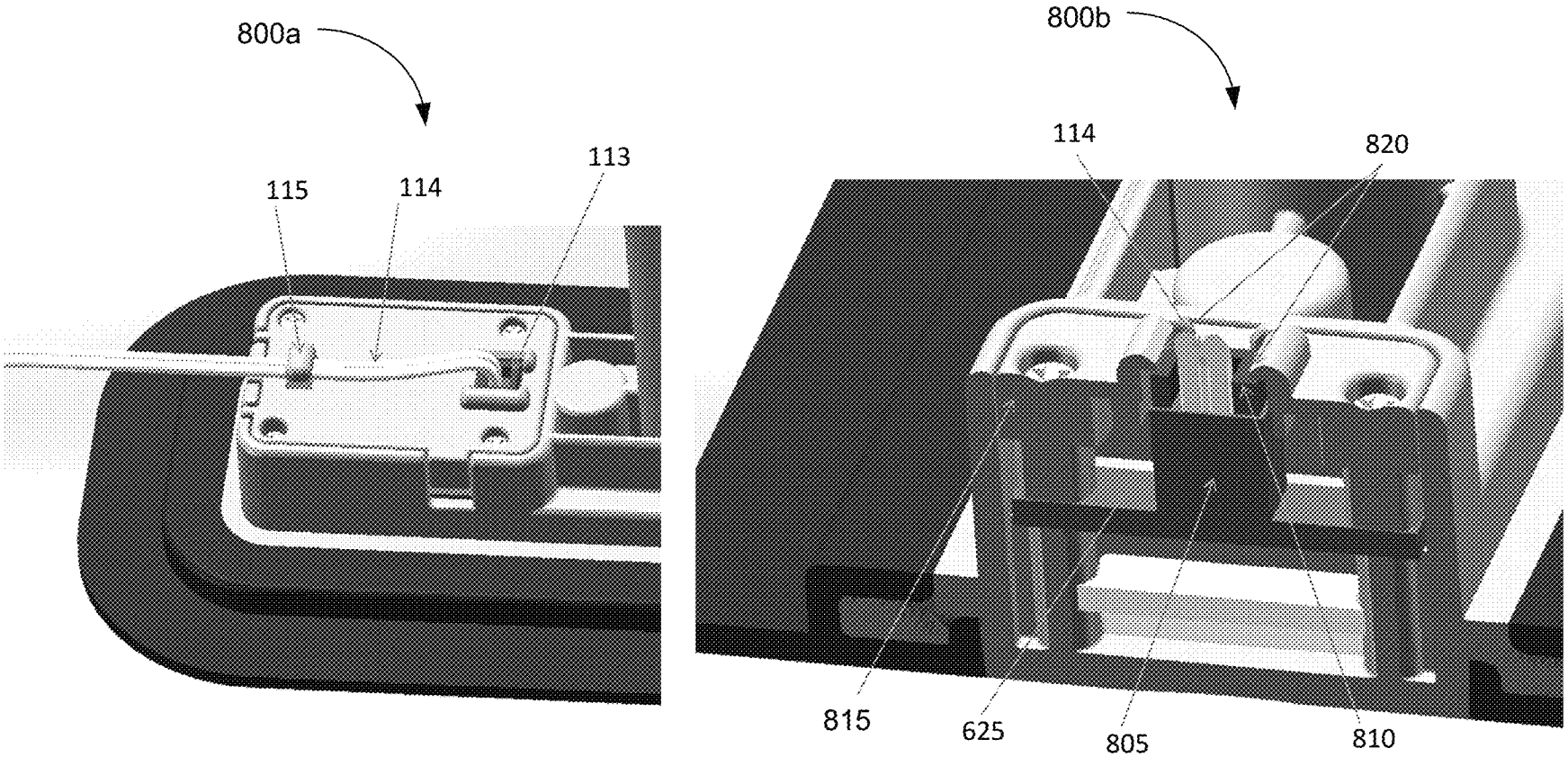
FIG. 8 illustrates a connector of a control box of lighted inflatable product according to an example embodiment.

FIG. 8 illustrates various aspects of a connector 113 according to an example embodiment from both perspective 800*a* and cutaway 800*b* views. FIG. 8 shows a connector housing 810, wiring 114, and wire lock 115. Wiring 114 extends from the connector housing 810 to provide power to lighting elements 108. Wire lock 115 reinforces the position and enhances the firmness of the wiring 114. Connector 113 may include male connector 810 and female connector 805. Female connector 805 may be formed integrally with PCBA 525.

Cover 535 (e.g., PCB Cover 535) includes a hook 820 and wire lock 115. The cover 535 and hook 820 holds male connector 810 in place, and wire lock 115 reinforces the position and the firmness of wiring 114. In some embodiments, control box 112 has the advantages of small volume and light weight.

Figure 9:
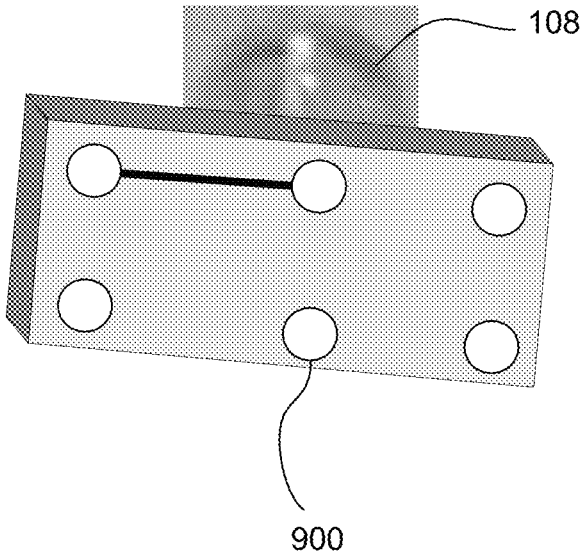
FIG. 9 is a view of an onboard limiting resistor according to an example embodiment.

FIG. 9 illustrates an onboard limiting resistor. The onboard limiting resistor 900 may be attached to each lighting element 108 (e.g., LEDs). The onboard limiting resistor 900 may be designed to ensure that each LED of the group of LEDs emits a same light intensity. In some cases, the onboard limiting resistor 900 may be further designed for EMI in the manufacturing process.

While certain embodiments of the disclosed technology have been described, it is to be understood that the disclosed technology is not to be limited to the disclosed example embodiments, but covers various modifications and equivalent arrangements included within the scope of the appended claims. Although specific terms are employed herein, they are used in a generic and descriptive sense only and not for purposes of limitation.

This written description uses examples to disclose certain embodiments of the disclosed technology, including the best mode, and to enable any person skilled in the art to practice the disclosed technology, including making and using any devices or systems and performing any incorporated methods. The patentable scope may include other examples that occur to those skilled in the art. Such other examples are intended to be within the scope of the claims if they have structural elements as the claims, or if they include equivalent structural elements with insubstantial differences from the literal language of the claims.

What is claimed is:

1. An inflatable pool comprising:

a side wall comprising a first inflatable chamber, the side wall defining an interior volume of the inflatable pool;

at least one lighting element disposed within the side wall such that the at least one lighting element is sealed inside the first inflatable chamber and isolated from an external environment, the at least one lighting element configured to emit light and the at least one lighting element oriented to face a central point of the inflatable pool; and a control box connected to the at least one lighting element, the control box configured to control one or more emission states of the at least one lighting element.

2. The inflatable pool of claim 1, wherein the side wall forms a recess, the control box being positioned in the recess.

3. The inflatable pool of claim 1, wherein the control box comprises:

a main housing;

a power button; and a switch operatively connected to the power button and sealed from the power button, the switch being configured to alter an operating mode of the control box.

4. The inflatable pool of claim 3, wherein the control box further comprises a seal disposed between the power button and the switch.

5. The lighted inflatable device of claim 4, wherein the control box further comprises a filler between an edge of the seal and the main housing.

6. The inflatable pool of claim 3, wherein the control box further comprises a control circuit configured to control the one or more emission states of the at least one lighting element.

7. The inflatable pool of claim 6, wherein the control box further comprises a frame configured to hold the control circuit.

8. The inflatable pool of claim 7, wherein the frame provides a water-tight seal around the control circuit.

9. The inflatable pool of claim 3, wherein the control box further comprises a battery housing configured to receive one or more batteries.

10. The lighted inflatable device of claim 1 further comprising: one or more rigid internal members attached perpendicularly to two surfaces of the first inflatable chamber, wherein the at least one lighting element is attached to the one or more rigid internal members.

11. An inflatable pool comprising:

a side wall comprising a first inflatable chamber, the side wall defining an interior volume of the inflatable pool;

at least one lighting element disposed within the side wall such that the at least one lighting element is sealed inside the first inflatable chamber and isolated from an external environment, the at least one lighting element configured to emit light and the at least one lighting element oriented to face a central point of the inflatable pool;

at least one impact sensor configured to detect physical impact to the side wall; and a control box connected to the at least one lighting element, the control box configured to control one or more emission states of the at least one lighting element.

12. The inflatable pool of claim 11, wherein the inflatable pool is configured to alter, in response to the at least one impact sensor detecting physical impact to the side wall, an emission state of the at least one lighting element.

13. The inflatable pool of claim 12, wherein altering the emission of the at least one lighting element comprises at least one from among adjusting a brightness of the at least one lighting element, adjusting a flicker state of the at least one lighting element, adjusting a color of the at least one lighting element, and adjusting an on state of the at least one lighting element.

14. The inflatable pool of claim 12, wherein the inflatable pool is further configured revert, after a predetermined period of time following the at least one impact sensor detecting physical impact to the side wall, the emission state of at least one lighting element.

15. The inflatable pool of claim 12, wherein the at least one impact sensor is embedded with the at least one lighting element.

16. The inflatable pool of claim 12, wherein the inflatable pool is configured to cycle, in response to the at least one impact sensor detecting successive physical impacts to the side wall, the emission state of the at least one lighting element.

17. The inflatable pool of claim 11, wherein the inflatable pool is configured to alter, in response to a first impact sensor of the at least one impact sensor detecting physical impact to the side wall, an emission state of one or more lighting elements of the at least one lighting elements proximate to the first impact sensor.

18. The inflatable pool of claim 11 comprising:

a plurality of impact sensors disposed about the side wall; and a plurality of lighting elements disposed about the side wall and within the first inflatable chamber, wherein each of the plurality of impact sensors are configured to, in response to detecting an impact, alter an emission state of a respective subset of the plurality of lighting elements.

19. The inflatable pool of claim 18, wherein each of the plurality of impact sensors is embedded with, and configured to control, a respective lighting element of the plurality of lighting elements.

20. An inflatable pool comprising:

a side wall comprising a first inflatable chamber, the side wall defining an interior volume of the inflatable pool;

a first plurality lighting elements disposed within the side wall and oriented to face a central point of the inflatable pool such that the each of the first plurality of lighting elements is sealed inside the first inflatable chamber and isolated from an external environment, the first plurality of lighting elements configured to emit light;

a control box connected to the first plurality of lighting elements, the control box configured to control one or more emission states of the first plurality of lighting elements;

a second plurality of lighting elements disposed within the side wall and oriented to face a central point of the inflatable pool such that the each of the second plurality of lighting elements is sealed inside the first inflatable chamber and isolated from an external environment, the second plurality of lighting elements configured to emit light; and at least one impact sensor configured to detect physical impact to the side wall and control, in response to detecting physical impact to the side wall, one or more emission states of the second plurality of lighting elements.

* * * * *